United States Patent [19]

Bonnett et al.

[11] Patent Number: 4,758,166

[45] Date of Patent: Jul. 19, 1988

[54] CONCEALED RADIO ANTENNA

[75] Inventors: Roy E. Bonnett, Birmingham, Mich.; Earl S. Calcut, Syracuse, Utah

[73] Assignee: Ford Motor Company, Dearborn, Mich.

[21] Appl. No.: 915,833

[22] Filed: Oct. 6, 1986

Related U.S. Application Data

[63] Continuation-in-part of Ser. No. 848,873, Apr. 7, 1986, abandoned.

[51] Int. Cl.[4] ..... H01Q 1/32

[52] U.S. Cl. ..... 343/712; 343/711; 343/713

[58] Field of Search ..... 343/712, 713, 711

[56] References Cited

U.S. PATENT DOCUMENTS

| | | | |
|---|---|---|---|
| 2,575,471 | 11/1951 | Schweiss et al. | 343/712 |
| 2,859,441 | 11/1958 | Rosenbaum | 343/712 |
| 3,611,388 | 10/1971 | Okumura | 343/712 |
| 3,646,561 | 2/1972 | Clarke | 343/711 |
| 3,896,448 | 7/1975 | Killen et al. | 343/713 |
| 4,132,994 | 1/1979 | Caldwell | 343/713 |
| 4,370,658 | 1/1983 | Hill | 343/713 |

FOREIGN PATENT DOCUMENTS

| | | | |
|---|---|---|---|
| 1218889 | 3/1969 | United Kingdom | 343/713 |

*Primary Examiner*—William L. Sikes
*Assistant Examiner*—Hoanganh Le
*Attorney, Agent, or Firm*—Paul K. Godwin, Jr.; Clifford L. Sadler

[57] ABSTRACT

A low cost concealed radio antenna makes use of a weather seal gasket material used to surround an automotive body opening. The weather seal gasket contains a metal carrier strip functions as the antenna conductor when connected to a radio antenna terminal.

6 Claims, 3 Drawing Sheets

CONCEALED RADIO ANTENNA

RELATED APPLICATION

The present invention is a continuation-in-part of our copending U.S. patent application Ser. No. 848,873, filed Apr. 7, 1986, now abandoned.

BACKGROUND OF THE INVENTION

1. Field of the Invention

The present invention is directed to the field of radio antennas for automotive vehicles and more specifically to the area of concealed antennas in such vehicles.

2. Description of Prior Art

Several prior art concepts have been disclosed in which a radio antenna is embodied in a portion of the vehicle, concealed from view. For instance, U.S. Pat. No. 3,896,448 describes a radio antenna which is formed by a conductor supported by a non-conductive top portion of an instrument panel assembly so as to collect radio waves passing through the windshield opening from outside the vehicle. U.S. Pat. No. 4,370,658 describes a laminated structure in which a pair of antenna conductors are encapsulated within a sandwich of electrically insulated material and that structure is employed on the outer portion of the vehicle. U.S. Pat. No. 4,132,994 is directed to a radio antenna for use on a motorcycle having a windshield mounted on a non-conducting fairing wherein the conductive member used for the antenna is shaped to conform to and extend along the edge of the windshield around a substantial portion of its periphery. U.S. Pat. No. 3,646,561 is directed to a radio antenna which is adhesively secured to an automotive windshield wherein the conductive member of the antenna is encapsulated within a pressure sensitive tape.

In each of the prior art attempts to devise a concealed radio antenna, special accommodations regarding lamination or special configurations must be employed, in order to implement the concepts.

SUMMARY OF THE INVENTION

In the present invention, it is possible to use a conventional weather seal gasket containing a metallic carrier structure as a radio antenna when that gasket is mounted to surround a vehicular body opening and a closure for that opening is made of a material which is substantially transparent to electromagnetic radio wave energy.

It is therefore an object to the present invention to provide a concealed radio antenna utilizing conventional and readily available weather sealing gasket products mounted to surround a vehicular body opening.

It is a further object of the present invention to accommodate either a long wire or dipole type antenna.

BRIEF DESCRIPTION OF THE DRAWINGS

FIG. 4 is a detailed view of the seam portion of the gasket, where the two ends are joined.

DETAILED DESCRIPTION OF THE PREFERRED EMBODIMENT

Figure 1:
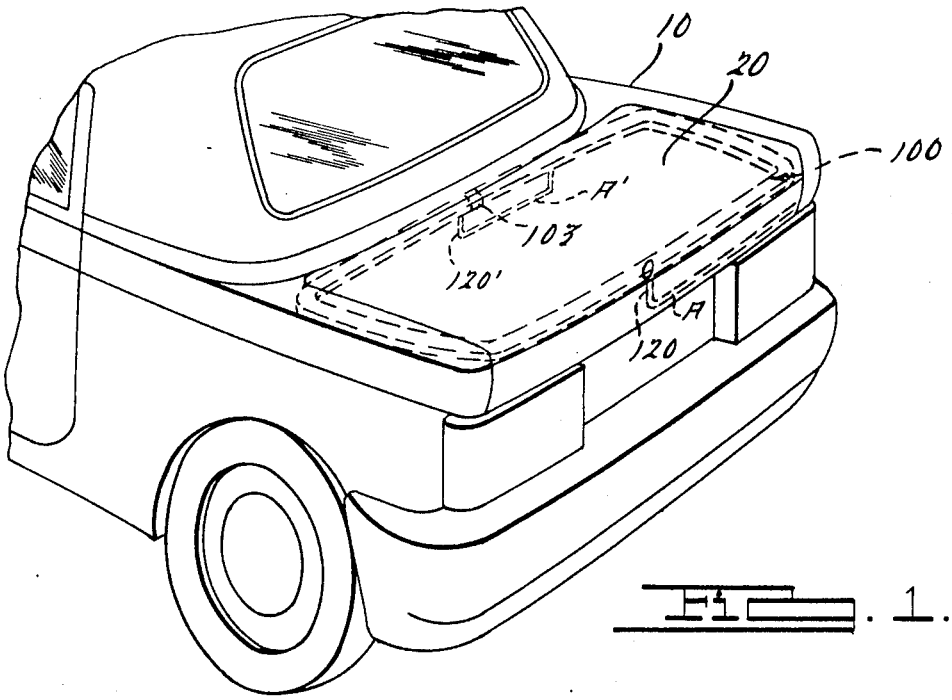
FIG. 1 is a plan view of a vehicle illustrating the environment of both the described embodiments of the present invention.
Figure 3:
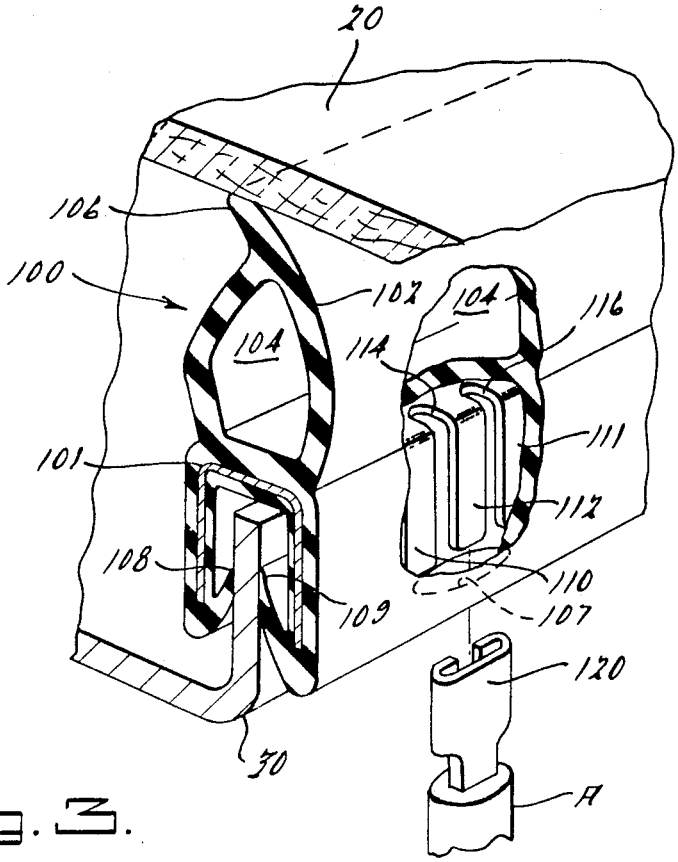
FIG. 3 is a detailed cross-sectional view of the weather sealing gasket which is employed in both embodiments of the present invention.

In FIG. 1, an automotive vehicle 10 is depicted as having a generally rectangular storage compartment opening in its rear portion that lies in a generally horizontal plane. The vehicle body opening is encircled by a weather gasket 100 and with a closable deck lid cover 20. With reference to FIG. 3, the deck lid cover 20 is shown as being formed of a composite material such as a molded plastic or fiberglass that is non-conducting and substantially transparent to electromagnetic radiation. The invention makes use of a commercially available rubber gasket 100, that contains an electrically conducting carrier structure, as an antenna (such weather strip gaskets are commercially available from such sources as Sheller Globe and General Tire Co.). Accordingly, the gasket 100 is installed on the flange forming the peripheral edge of the body opening. An insulated plug piece 103 is employed between the ends of the gasket material 100 to separate the conducting portion thereof. An alternative joint would be effective if the insulator ends were joined and the conducting portions were cut back so as to be separated.

Figure 2:
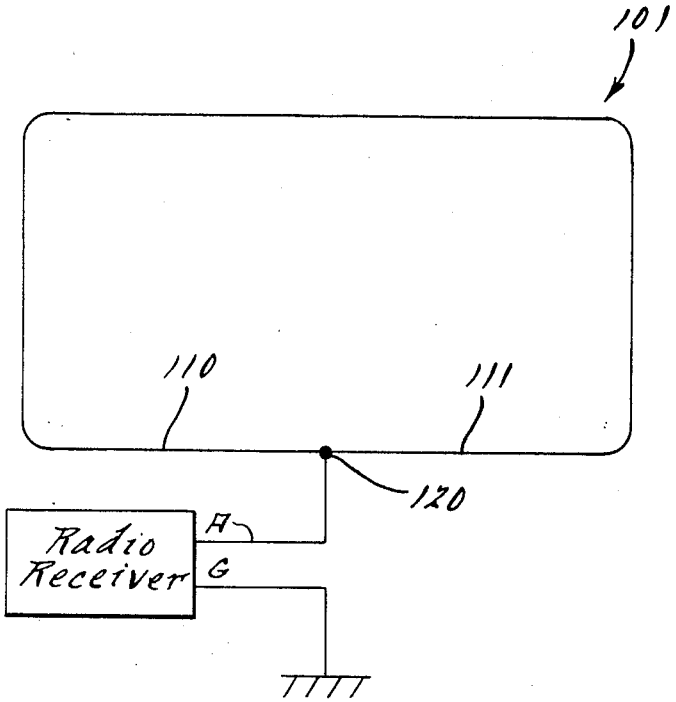
FIG. 2 is a schematic diagram illustrating the functional characteristics of a first embodiment of the present invention.
Figure 1:
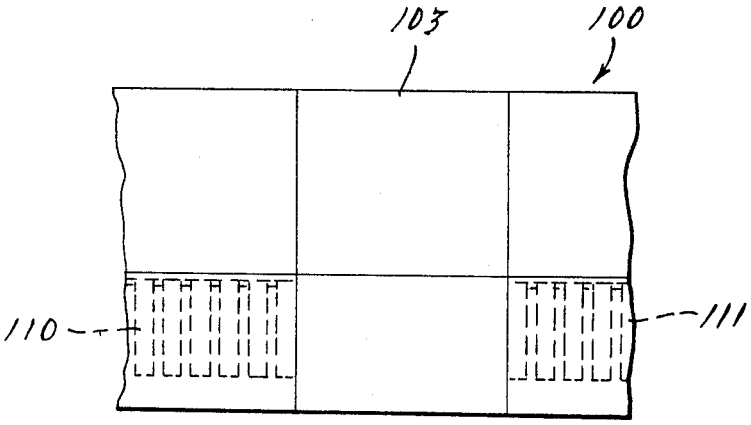

A schematic of a first embodiment of the antenna is shown in FIG. 2, wherein the electrical conducting portion of the gasket 100 is represented as being divided into sections 110 and 111. An electrical terminal 120 provides interconnection between an antenna cable "A" connected to the antenna terminal of the radio receiver. The radio receiver ground is connected to vehicle chassis ground "G".

Cross-sectional detail of the present invention is provided in FIG. 3 wherein the gasket material 100 is illustrated as being formed of a flexible rubber material or the like which is primarily considered to be a moisture seal but also has electrical and thermal insulator properties. The upper portion of the gasket 100 contains a flexible lip 106 and an air core 104 which adds to the compressibility of the gasket 100. A flange 30 is formed in the body of the vehicle 10 to define the body opening and provide a mount for the gasket 100. The connecting portion of the gasket 100 is provided with a set of opposing retrorse fins 108 and 109 positioned to slip over the flange and resist removal therefrom. The metal carrier strip 101 is an electrical conductor that has a "U"-shaped cross-section. The carrier strip 101 is provided to add rigidity to the retrorse fin section of the gasket 100. The carrier strip 101 is molded within the gasket 100 and is substantially insulated with respect to the outer environment. In order to obtain access to the carrier strip 101, an aperture 107 is cut in the lower edge of the gasket material 100 so as to be aligned with one of the plurality of flexible tabs 112 defined by cuts 114 and 116 in the carrier strip 101. An electrical terminal 120 was found to mate with the tab 112 and inserted through the aperture 107 so as to make electrical contact therewith. The first embodiment is shown with the electrical terminal 120 positioned equidistant from the ends in the physical and electrical center of the carrier strip 101 so as to define left and right equal portions of the antenna 110 and 111. However, other configurations may also be made. For instance, a second embodiment is shown in FIG. 5, as a single open-ended loop.

The carrier strip 101 (101') is formed of a stamping having a number of tabs 112 separated by grooves 114 and 116 extending throughout the length of the gasket. The purpose of the grooves is to allow the carrier strip and the gasket 100 to be bent around the corners of the flange 30 and remain attached.

In order to provide separation at the ends of the antenna element 110 and 111, a filler piece 103 is fitted between the ends to provide separation and electrical insulation between those ends.

Figure 5:
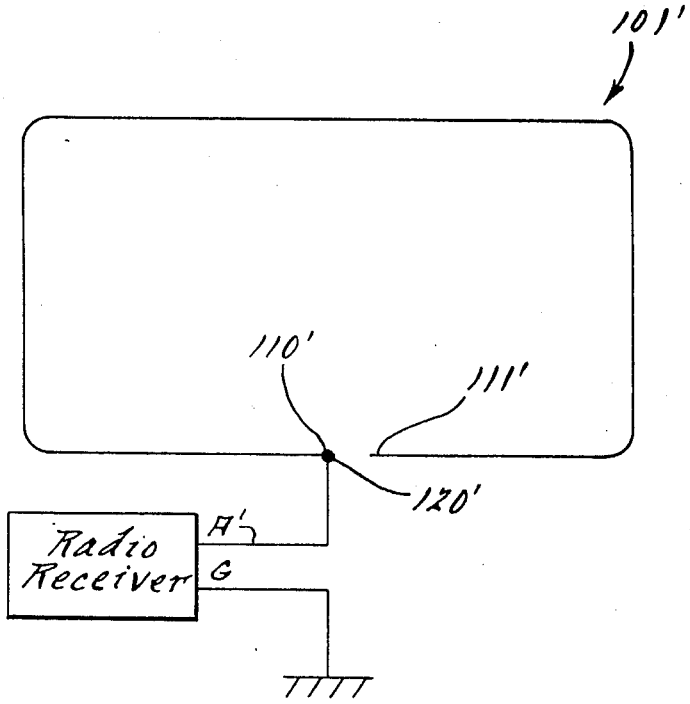
FIG. 5 is a schematic diagram illustrating the functional characteristics of the second embodiment of the present invention.
Figure 6:
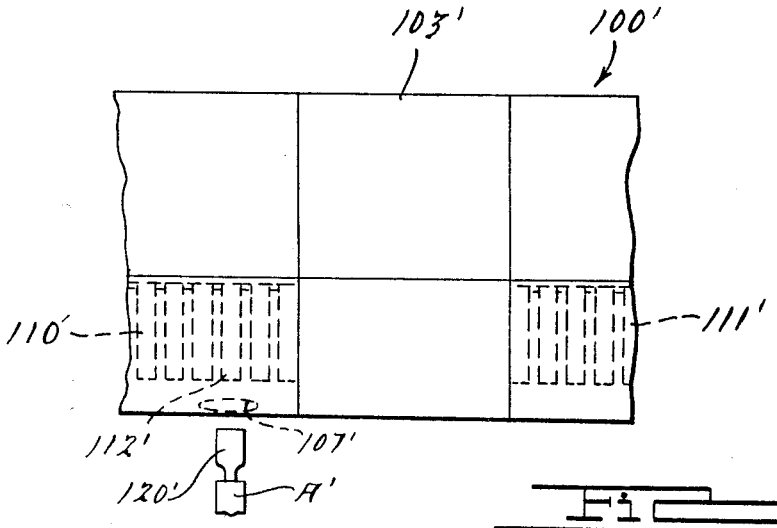
FIG. 6 is a detailed view of the seam portion of the gasket as configured for the second embodiment of the present invention.

As can be seen from FIGS. 1 and 5, an electrical terminal 120' from the antenna cable A' is connected to one end of the carrier strip 101'. In FIG. 6, an aperture 107' is shown formed in the lower edge of the gasket material 100', adjacent the plug piece 103, and aligned with one of the plurality of flexible tabs 112' in the antenna end portion 110'.

Of course, in order for the invention to function as an antenna in the location prescribed, with the deck lid 20 closed, the deck lid 20 must be formed of a material that is substantially transparent to electromagnetic radiation. The embodiment shown utilizes a fiberglass deck lid 20. However, it is anticipated that other materials with appropriate non-conducting properties could be substituted.

It will be apparent that the present invention makes use of an existing gasket material in a way which allows it to serve a secondary function as a radio antenna and thereby achieve significant cost savings per vehicle.

It will be further apparent that many modifications and variations may be implemented without departing from the scope of the novel concept of this invention. One such variation may be in using a sunroof opening having a gasket, such as that shown herein, to underlie a glass cover and to function as a radio antenna. It is intended by the appended claims to cover all such modifications and variations which fall within the true spirit and scope of the invention.

We claim:

1. A radio antenna, for an automotive vehicle containing a vehicle body opening and a cover for said body opening that is formed of a material that is substantially transparent to electromagnetic radio wave energy, comprising:

a weather sealing gasket mounted on said vehicle to surround said vehicle body opening so as to be in contact with said cover in its closed position;

a metallic conducting member having two ends embedded within said gasket so as to extend with said gasket about said opening;

said conducting member containing an electrical terminal located at a point equidistant between said ends for connecting said conducting member of the antenna input of a radio.

2. A radio antenna as in claim 1, wherein said conducting member within said gasket is electrically insulated from said vehicle body.

3. A radio antenna as in claim 2, wherein said gasket is formed of an insulating material and said conducting member is insulated from said vehicle body by said gasket material being formed to surround said member.

4. A radio antenna as in claim 2, wherein said vehicle body opening is a storage compartment opening and said cover is a storage compartment door operative between open and closed positions.

5. A radio antenna as in claim 4, wherein said vehicle body opening and said gasket lie in a generally horizontal plane.

6. A radio antenna as in claim 4, wherein said metallic conducting member within said gasket lies in a generally horizontal plane.

* * * * *